US006708759B2

(12) United States Patent
Léauté et al.

(10) Patent No.: US 6,708,759 B2
(45) Date of Patent: Mar. 23, 2004

(54) LIQUID ADDITION TO STEAM FOR ENHANCING RECOVERY OF CYCLIC STEAM STIMULATION OR LASER-CSS

(75) Inventors: Roland P. Léauté , Calgary (CA); Kathy E. Corry, Calgary (CA); B. Karl Pustanyk, Bragg Creek (CA)

(73) Assignee: ExxonMobil Upstream Research Company, Houston, TX (US)

( * ) Notice: Subject to any disclaimer, the term of this patent is extended or adjusted under 35 U.S.C. 154(b) by 26 days.

(21) Appl. No.: 10/114,854

(22) Filed: Apr. 2, 2002

(65) Prior Publication Data

US 2002/0144818 A1 Oct. 10, 2002

(51) Int. Cl.[7] ..... E21B 43/24

(52) U.S. Cl. ..... 166/272.4; 166/263; 166/272.7; 166/303

(58) Field of Search ..... 166/50, 263, 266, 166/267, 272.3, 272.4, 272.7, 303

(56) References Cited

U.S. PATENT DOCUMENTS

| | | | | |
|---|---|---|---|---|
| 2,365,591 A | | 12/1944 | Ranney | 166/269 |
| 2,862,558 A | * | 12/1958 | Dixon | 166/272.3 |
| 3,454,095 A | * | 7/1969 | Messenger et al. | 166/303 |

(List continued on next page.)

FOREIGN PATENT DOCUMENTS

| | | |
|---|---|---|
| CA | 1015656 | 8/1977 |
| CA | 1059432 | 7/1979 |
| CA | 1122115 | 4/1989 |
| CA | 2108349 | 8/1996 |
| CA | 2147079 | 10/1996 |
| CA | 2304938 | 2/2001 |
| CA | 2243105 | 11/2001 |

OTHER PUBLICATIONS

Gupta, S., Gittins, S., Picherack, P.,"Insights into Some Key Issues with Solvent Aided Process", Petroleum Society—Canadian Institute of Mining, Metallurgy & Petroleum, Paper No. 2001–126, pp 1–23, Jun. 12–14, 2001.

Vogel, J.V., "How Solvent Vapors Can Improve Steam Floods", World Oil, Nov. 1996.

Nasr, T.N., Kimber, K.D., Jha, K.N., "A Novel Scaled Physical Simulator for Horizontal Well Enhanced Oil Recovery", Petroleum Society of CIM and CANMET, Paper No. 5, pp 5–1 to 5–19, Oct. 7–9, 1991.

(List continued on next page.)

*Primary Examiner*—George Suchfield
(74) *Attorney, Agent, or Firm*—Gary P. Katz

(57) ABSTRACT

LASER-CSS provides a method to improve cyclic steam-based thermal recovery methods for heavy oils and bitumen. A key improvement over prior art consists of mixing liquid hydrocarbons into the injected steam instead of injecting such hydrocarbon as a separate slug in front of a steam stimulation cycle. The objective of the invention is to enhance field applications of Cyclic Steam Stimulation (CSS) by contacting and mobilizing more of the bitumen with the same amount of steam. This is to help increase the recovery efficiency and ultimate recovery normally achieved with conventional CSS-type process operations. The proposed LASER-CSS method utilizes existing CSS wells at some intermediate stage of reservoir depletion. Liquid hydrocarbons are directly mixed and flashed into the injected steam lines, injected into the CSS wellbores and further transported as vapors to contact heavy oil or bitumen surrounding steamed areas between adjacent wells. For the most part injected hydrocarbons are reproduced dissolved within the produced bitumen phase. The optimum loading of hydrocarbons injected with steam will be chosen to maximize pressure drawdown and fluid removal of the reservoir using conventional CSS artificial lift equipment already in place.

20 Claims, 1 Drawing Sheet

U.S. PATENT DOCUMENTS 3,459,265 A * 8/1969 Buxton et al. ..... 166/272.3
3,608,638 A 9/1971 Terwilliger
3,908,762 A 9/1975 Redford ..... 166/263
3,960,214 A 6/1976 Striegler et al.
3,986,557 A 10/1976 Striegler et al.
4,004,636 A 1/1977 Brown et al.
4,007,785 A 2/1977 Allen et al. ..... 166/263
4,020,901 A 5/1977 Pisio et al. ..... 166/50
4,026,358 A 5/1977 Allen ..... 166/261
4,034,812 A 7/1977 Widmyer ..... 166/303
4,037,658 A 7/1977 Anderson ..... 166/272
4,067,391 A 1/1978 Dewell ..... 166/303
4,085,803 A 4/1978 Butler ..... 166/303
4,099,568 A 7/1978 Allen ..... 166/269
4,109,720 A 8/1978 Allen et al. ..... 166/269
4,116,275 A 9/1978 Butler et al. ..... 166/303
4,127,170 A 11/1978 Redford ..... 166/252
4,160,481 A 7/1979 Turk et al.
4,166,503 A 9/1979 Hall et al. ..... 166/263
4,257,650 A 3/1981 Allen ..... 299/2
4,262,745 A 4/1981 Stewart ..... 166/263
4,271,905 A * 6/1981 Redford et al. ..... 166/402
4,280,559 A 7/1981 Best ..... 166/303
4,293,035 A 10/1981 Fitch ..... 166/273
4,296,969 A 10/1981 Willman ..... 299/2
4,324,291 A 4/1982 Wong et al.
4,344,485 A 8/1982 Butler ..... 166/271
4,372,383 A 2/1983 Ames ..... 166/266
4,373,585 A 2/1983 Fitch et al. ..... 166/263
4,379,592 A 4/1983 Vakhnin et al. ..... 299/2
4,385,662 A 5/1983 Mullins et al. ..... 166/263
4,390,067 A 6/1983 Willman ..... 166/245
4,434,849 A 3/1984 Allen
4,450,913 A 5/1984 Allen et al. ..... 166/303
4,460,044 A 7/1984 Porter
4,463,988 A 8/1984 Bouck et al. ..... 299/2
4,466,485 A 8/1984 Shu
4,498,537 A 2/1985 Cook ..... 166/257
4,501,326 A 2/1985 Edmunds
4,510,997 A 4/1985 Fitch et al. ..... 166/263
4,511,000 A 4/1985 Mims ..... 166/303
4,513,819 A 4/1985 Islip et al. ..... 166/263
4,519,454 A 5/1985 McMillen ..... 166/303
4,535,845 A 8/1985 Brown et al. ..... 166/272
4,565,245 A 1/1986 Mims et al. ..... 166/50
4,577,691 A 3/1986 Huang et al. ..... 166/263
4,589,486 A 5/1986 Brown et al.
4,592,424 A * 6/1986 Long et al. ..... 166/402
4,597,441 A * 7/1986 Ware et al. ..... 166/261
4,598,770 A 7/1986 Shu et al. ..... 166/245
4,640,359 A 2/1987 Livesey et al. ..... 166/276
4,682,652 A 7/1987 Huang et al. ..... 166/263
4,687,058 A * 8/1987 Casad et al. ..... 166/272.2
4,697,642 A 10/1987 Vogel ..... 166/263
4,700,779 A 10/1987 Huang et al. ..... 166/263
4,706,751 A 11/1987 Gondouin
4,753,293 A 6/1988 Bohn ..... 166/267
4,794,987 A 1/1989 Kokolis et al. ..... 166/274
4,818,370 A 4/1989 Gregoli et al. ..... 208/106
4,834,179 A 5/1989 Kokolis et al. ..... 166/268
4,844,158 A 7/1989 Jennings, Jr. ..... 166/267
4,850,429 A 7/1989 Mims et al. ..... 166/245
5,060,726 A 10/1991 Glandt et al. ..... 166/248
5,148,869 A 9/1992 Sanchez ..... 166/303
5,167,280 A 12/1992 Sanchez et al. ..... 166/267
5,215,146 A 6/1993 Sanchez ..... 166/263
5,215,149 A 6/1993 Lu ..... 166/303
5,244,041 A 9/1993 Renard et al. ..... 166/268
5,273,111 A 12/1993 Brannan et al. ..... 166/245
5,339,897 A 8/1994 Leaute ..... 166/245
5,407,009 A 4/1995 Butler et al. ..... 166/266
5,411,094 A 5/1995 Northrop ..... 166/303
5,413,175 A 5/1995 Edmunds ..... 166/252
5,417,283 A 5/1995 Ejiogu et al. ..... 166/272
5,456,315 A 10/1995 Kisman et al. ..... 166/245
5,503,226 A 4/1996 Wadleigh ..... 166/252.1
5,607,016 A 3/1997 Butler ..... 166/263
5,626,193 A 5/1997 Nzekwu et al. ..... 166/303
5,685,371 A 11/1997 Richardson et al. ..... 166/272
5,771,973 A 6/1998 Jensen et al. ..... 166/303
5,803,171 A 9/1998 McCaffery et al. ..... 166/245
5,826,655 A 10/1998 Snow et al. ..... 166/272.3
5,860,475 A 1/1999 Ejiogu et al. ..... 166/245
5,899,274 A 5/1999 Frauenfeld et al. ..... 166/401
5,931,230 A 8/1999 Lesage et al. ..... 166/303
6,050,335 A 4/2000 Parsons ..... 166/272.3
6,119,776 A 9/2000 Graham et al. ..... 166/245
6,158,510 A 12/2000 Bacon et al. ..... 166/272.7
6,167,966 B1 1/2001 Ayasse et al. ..... 166/268
6,186,232 B1 2/2001 Isaacs et al. ..... 166/272.3
6,230,814 B1 5/2001 Nasr et al. ..... 166/400
6,257,334 B1 7/2001 Cyr et al. ..... 166/272.7
6,263,965 B1 7/2001 Schmidt et al. ..... 166/272.3
6,305,472 B2 10/2001 Richardson et al. ..... 166/305.1
6,318,464 B1 11/2001 Mokrys ..... 166/252.01
2001/0018975 A1 9/2001 Richardson et al. ..... 166/305.1
2003/0000711 A1 * 1/2003 Gutek et al. ..... 166/402

OTHER PUBLICATIONS

Cuthiell, D., McCarthy, C., Frauenfeld, T., Cameron, S., Kissel, G., "Investigation of the Vapex Process Using CT Scanning and Numerical Simulation", Petroleum Society—Canadian Institute of Mining, Metallurgy & Petroleum, Paper No. 2001–128, pp 1–17, Jun. 12–14, 2001.

Nghiem, L.X., Kohse, B.F., Sammon, P.H., "Compositional Simulation of the Vapex Process", Petroleum Society—Canadian Institute of Mining, Metallurgy & Petroleum, Paper No. 2000–34, Jun. 4–8, 2000.

Doan, Q., Doan, L., Ali, S. M. Farouq, George, A.E., "Usefulness of Scaled Models in Heavy Oil Recovery Development by Steam and Horizontal Wells", 6th UNITAR International Conference, Houston Texas, pp 689–706, Feb. 12–17, 1995.

Das, S. K., Butler, R. M., "Extraction of Heavy Oil and Bitumen Using Solvents at Reservoir Pressure", Petroleum Society of CIM, Paper No. 95–118, pp 1–15, Oct. 16–18, 1995.

Butler, R.M., Mokrys, I.J., "A New Process (VAPEX) for Recovering Heavy Oils using Hot Water and Hydrocarbon Vapour", Petroleum Society of CIM/Society of Petroleum Engineers Paper No. CUM/SPE 90–133, pp 133–1–133–15, Jun. 10–13, 1990.

Jha, K.N., Butler, R.M., Lim, G.B., Oballa V., "Vapour Extraction (VAPEX) Process for Recovery of Heavy Oil and Bitumen", 6th UNITAR International Conference, Houston Texas, pp 759–774, Feb. 12–17, 1995.

Chang, H.L., Ali S.M. Farouq, George, A.E., "Performance of Horizontal–Vertical Well Combinations for Steamflooding Bottom Water Formations", Petroleum Society of CIM/Society of Petroleum Engineers, Paper No. CIM/SPE 90–86, pp 86/1–16, Jun. 10–13, 1990.

Chang, H.L., Ali S.M. Farouq, George, A.E., "Steamflood Applications for Marginal Heavy Oil Reservoirs with Underlying Bottom Water", 5th Unitar International Conference on Heavy Crude and Tar Sands, pp 193–205, 1992.

Butler, R., Yee, C. T., "Progress in the In Situ Recovery of Heavy Oils and Bitumen", Petroleum Society—Canadian Institute of Mining, Metallurgy & Petroleum, Paper No. 2000–50, Jun. 4–8, 2000.

Jiang, Q., Butler, R.M., Yee C.T., "Steam and Gas Push (SAGP)—4; Recent Theoretical Developments and Laboratory Results Using Layered Models", Petroleum Society—Canadian Institute of Mining, Metallurgy & Petroleum, Paper No. 2000–51, Jun. 4–8, 2000.

Butler, R.M., "Application of SAGD, Related Processes Growing in Canada", Oil and Gas Journal, pp 74–78, May 14, 2001.

Minssieux, L., Bardon, C., Rouet, J., Groffe, P., "Effects of Asphaltene Deposition in Production Treatment and Prevention Tests", International Symposium on Colloid Chemistry in Oil Production, Nov. 26–29, 1995.

Butler, R.M., "SAGD Comes of Age", JCPT.

Butler, R.M., Yee, C.T., "An Experimental Study of Steam Condensation in the Presence of Non–condensable Gases in Porous Solids", AOSTRA Journal of Research, vol. 3, No. 1, pp 15–23, 1986.

Butler, R.M., "Steam and Gas Push (SAGP)", The Petroleum Society, Paper No. 97–137, pp 1–15, Jun. 8–11, 1997.

Jiang, Q., Butler, R.M., Yee, C.T., "The Steam and Gas Push (SAGP)—2: Mechanism Analysis and Physical Model Testing", The Petroleum Society, Paper No. 98–43, Jun. 8–10, 1998.

Jiang, Q., Butler, R.M., Yee, C.T., "Development of the Steam and Gas Push (SAGP) Process", GravDrain, Paper No. 1998.59, pp. 1–18, 1998.

Butler, R.M., Jiang, Q., Yee, C.T., "Steam and Gas Push (SAGP)—3; Recent Theoretical Developments and Laboratory Results", The Petroleum Society, Paper No. 99–23, Jun. 14–18, 1999.

Briggs, P.J., Beck, D.L., Black, C.J.J., Bissell, R., "Heavy Oil from Fractured Carbonate Reservoirs", Society of Petroleum Engineers, Inc., SPE No. 19671, May 1992.

Petit, H.J.–M., Renard, G., Valentin, E., "Technical and Economic Evaluation of Steam Injection with Horizontal Wells for Two Typical Heavy–Oil Reservoirs", Society of Petroleum Engineers, Inc., SPE No. 19828, pp 619–629, Oct. 8–11, 1989.

Mokrys, I.J., Butler, R.M., "In–Situ Upgrading of Heavy Oils and Bitumen by Propane Deasphalting: The Vapex Process", Society of Petroleum Engineers, Inc., SPE No. 25452, pp 409–424, Mar. 21–23, 1993, pp. 409–424.

Richardson, W.C., Chu, C., "Composition of Remaining Oil in a Mature Steamflood", Society of Petroleum Engineers, Inc., SPE No. 27796, pp. 137–151, Apr. 17–20, 1994.

Donnelly, J.K., Chmilar M.J., "The Commercial Potential of Steam Assisted Gravity Drainage", Society of Petroleum Engineers, Inc., SPE No. 30278, pp 295–308, Jun. 19–21, 1995.

Butler, R.M., Mokrys, I.J., Das, S.K., "The Solvent Requirements for Vapex Recovery", Society of Petroleum Engineers, Inc., SPE No. 30293, pp 465–474, Jun. 19–21, 1995.

Palmgren, C., Edmunds, N., "High Temperature Naptha to Replace Steam in the SAGD Process", Society of Petroleum Engineers, Inc., SPE No. 30294, pp 475–478, Jun. 19–21, 1995.

Das, S.K., Butler, R.M., "Countercurrent Extraction of Heavy Oil and Bitumen", Society of Petroleum Engineers, Inc., SPE No. 37094, pp 501–510, Nov. 18–20, 1996.

Singhal, A.K., Das, S.K., Leggitt, S.M., Kasraie, M., Ito, Y., "Screening of Reservoirs for Exploitation by Application of Steam Assisted Gravity Drainage/Vapex Processes", Society of Petroleum Engineers, Inc., SPE No. 37144, pp 867–876, Nov. 18–20, 1996.

Jiang, Q., Butler, R.M., "Selection of Well Configurations in Vapex Process", Society of Petroleum Engineers, Inc., SPE No. 37145, pp 877–885, Nov. 18–20, 1996.

Escobar, M.A., Valera, C.A., Perez, R.E., "A Large Heavy Oil Reservoir in Lake Maracaibo Basin: Cyclic Steam Injection Experiences", Society of Petroleum Engineers, Inc., SPE No. 37551, pp 347–447, Feb. 10–12, 1997.

Davies, D.K., Mondragon, J.J., Hara, P.S., "A Novel Low Cost Well Completion Technique Using Steam for Formations with Unconsolidated Sands, Wilmington Field, California", Society of Petroleum Engineers, Inc., SPE Paper No. 38793, pp. 433–447, Oct. 5–8, 1997.

Das, S. K., "Vapex: An Efficient Process for the Recovery of Heavy Oil and Bitumen", Society of Petroleum Engineers, Inc., SPE Paper No. 50941, pp 232–237, Feb. 10–12, 1997.

Yuan, J.Y., Tremblay, B., Babchin, A., "A Wormhole Network Model of Cold Production in Heavy Oil", Society of Petroleum Engineers, Inc., SPE Paper No. 54097, pp 1–7, Mar. 17–19, 1999.

Escobar, E., Valco, P., Lee, W.J., Rodriguez, M.G., "Optimization Methodology for Cyclic Steam Injection with Horizontal Wells", Petroleum Society—Canadian Institute of Mining, Metallurgy & Petroleum, Paper No. CIM 65525, pp 1–12, Nov. 6–8, 2000.

Nghiem, L.X., Sammon P.H., Kohse, B.F., "Modeling Asphaltene Precipitation and Dispersive Mixing in the Vapex Process", Society of Petroleum Engineers, Inc., SPE Paper No. 66361, pp 1–11, Feb. 11–14, 2001.

Stone, T.W., Bennett, J., Holmes, J.A., "Thermal Simulation with Multisegment Wells", Society of Petroleum Engineers, Inc., SPE Paper No. 66373, pp 1–13, Feb. 11–14, 2001.

Batycky, J., "An Assessment of In situ Oil Sands Recovery Processes", The Journal of Canadian Petroleum Technology, vol. 36, No. 9, pp. 15–19, Oct. 1997.

Butler, R.M. and Mokrys, I.J., "A New Process (VAPEX) for Recovering Heavy Oils Using Hot Water and Hydrocarbon Vapour", JCPT, vol. 30, No. 1, pp. 97–106, Jan.–Feb. 1991.

Butler, R.M. and Mokrys, I.J., Recovery of Heavy Oils Using Vapourized Hydrocarbon Solvents: Further Developments of the VAPEX Process.; JCPT, vol. 32, No. 6, pp. 56–62, Jun. 1993.

S.K. Das and Butler, R.M., "Effect of Asphaltene Deposition on the VAPEX Process: A Preliminary Investigation Using A Hele–Shaw Cell", JCPT, vol. 33, No. 6, pp. 39–45, Jun. 1994.

Das, S.K., "In Situ Recovery of Heavy Oil and Bitumen Using Vaporized Hydrocarbon Solvents", Dissertation for the Degree of Doctor of Philosophy, The University of Calgary, Mar. 1995.

Palmgren, C. and Edmunds, N.; "High Temperature Naptha to Replace Steam in the SAGD Process", International Heavy Oil Symposium, Calgary, Alberta Canada, Jun. 19–21, 1995, SPE 30294.

Butler, R.M., "Thermal Recovery of Oil and Bitumen", GravDrain Inc., Calgary Alberta, Aug. 1997.

Komery, D.P., Luhning, R.W., Pearce, J.V., Goo, W.K., "Pilot Testing of Post–Steam Birumen Recovery from Mature SAGD Wells in Canada", Seventh UNITAR International Conference, Beijing, China, Oct. 27–31, 1998.

S.K. Das and Butler, R.M., "Mechanism of the Vapor Extraction Process for Heavy Oil and Bitumen", Journal of Petroleum Science and Engineering 21, pp. 43–59, 1998.

Saltuklaroglu, M., Wright, G.N., Conrad, P.R., McIntyre, J.R., Manchester, G.T. "Mobile's SAGD Experience at Celtic Saskatchewan", CSPG and Petroleum Society Joint Convention, Calgary, Alberta Canada, Jun. 14–18, 1999.

Donnelly, J.K., "The Best Process for Cold Lake CSS Verses SAGD", CSPG and Petroleum Society Joint Convention, Calgary, Alberta Canada, Jun. 1999.

Luhning, R.W., Lugning, C.P., "The Vapex Process: Non–Thermal Recovery of Birumen and Heavy Oil for Improved Economics and Climate Change Advantage", CHOA Conference, Calgary, Alberta, Canada, Nov. 24, 1999.

Butler, R.M., Bharatha, S., Yee, C.–T., "Natural and Gas–lift in SAGD Production Wells", Journal of Canadian Petroleum Technology, vol. 39, No. 1 1, pp. 18–29, Jan. 2000.

Butler, R.M., Jiang, W., "Imrpvoed Recovery of Heavy Oils by Vapex with Widely Spaced Horizontal Injectors and Producers", JCPT, vol. 39, No. 1, pp. 48–56, Jan. 2000.

Lim, G.B., Kry, R.P., Harker, B.C., Jha, K.N., "Cyclic Stimulation of Cold Lake Oil Sand with Supercritical Ethane", Society of Petroleum Engineers, Inc., SPE Paper No. 30298, pp 521–528, Jun. 19–21, 1995.

Lim,, G.B., Kry, R.P., Harker, B.C., Jha, K.N., "Three Dimensional Sclaed Physical Modeling of Solvent Vapour Extraction of Cold Lake Bitumen", Canadian SPE/CIM/CANMET Paper No. HWC94–46, Mar. 20–23, 1994.

Batycky, J., "An Assessment of In situ Oil Sands Recovery Processes", The Journal of Canadian Petroleum Technology, vol. 36, No. 9, pp. 15–19, Oct. 1997.

* cited by examiner

LIQUID ADDITION TO STEAM FOR ENHANCING RECOVERY OF CYCLIC STEAM STIMULATION OR LASER-CSS

CROSS-REFERENCE TO RELATED APPLICATION

This application claims priority from Canadian Patent Application No. 2,342,955 filed Apr. 4, 2001.

BACKGROUND OF INVENTION

As described in U.S. Pat. No. 4,280,559 or Canadian Patent No. 1,144,064, the most common and proven method for recovering viscous hydrocarbons is by using a steam stimulation technique, commonly called the "huff and puff" or "steam soak" process. Artificial lifting methods are normally employed to maximize at each cycle the inflow of mobilized reservoir fluids as the stimulated steamed areas are depressurized and cooled. Production is terminated when it is no longer economical to further extend the production cycle and steam needs to be injected again. Cyclic steam stimulation "CSS" cycles can be repeated many times until oil production is insufficient to remain economical due to decreasing thermal efficiency. After several decades, the fact remains that CSS remains the only in situ process, which has been proven to be effective on a commercial basis in Canadian tar sands. Therefore, there is still a strong need to further develop methods that can increase the productivity of CSS wells in order to decrease lifting costs associated to CSS steam generation and water recycle requirements. These costs usually become prohibitive at some limited level of recovery in so-called mature CSS areas. The change-over from cyclic to continuous steaming operations or infilling additional wells has not yet been proven commercially viable and our invention therefore aims at specifically improving performance of base CSS operations without having to modify the configuration and/or functionality of existing wells in the field. Enhancement of the CSS process will allow us to extend its useful life and increase the ultimate recovery of original oil in place.

The concept of using light hydrocarbons as steam additives is not new, as evidenced by several patents granted in the late seventies and early eighties. Various methods have been proposed to use hydrocarbon solvents in combination with steam to improve heavy oil recoveries in a wide range of reservoir conditions and well configurations. Of particular relevance to our CSS target application, Best had described in U.S. Pat. No. 4,280,559, an improved steam stimulation process. After one or more steam stimulation cycles to establish substantial fluid mobility around each CSS well, Best proposed to inject a slug of an appropriate hydrocarbon solvent prior to subsequent CSS cycles. He specified the hydrocarbon solvent as a hydrocarbon fraction containing a low concentration of low molecular weight paraffinic hydrocarbons, which has a boiling point range for the most part less than the steam injection temperature and greater than the initial reservoir temperature. The boiling point range he specified thus excluded the use of butane and lighter hydrocarbons; which typically boil below initial reservoir temperature (13° C. in Cold Lake Clearwater formation where the largest CSS commercial operations are developed). As shown in FIG. 3 of Best's original patent, the use of coker butanerich gas had shown no beneficial effects in his experimental tests. In another preferred embodiment of his process, Best had professed to inject a quantity of solvent between about 5 to about 15 volume percent of the cumulative oil volume produced from previous CSS cycles at a well. His range more or less overlaps with the expected range of concentrations expected for applying Liquid Addition to Steam for Enhancing Recovery of Cyclic Steam Stimulation, or (LASER-CSS.)

Subsequent to Best, Allen et al. described in U.S. Pat. No. 4,450,913 a superheated solvent method including from butane to octane for recovering viscous petroleum. However, there was no provision for injection of steam into the formation as described in their supporting experimental work with Utah tar sand cores. In U.S Pat. No. 4,498,537, Cook describes a producing well stimulation method—a combination of thermal and solvent. However his method uses an in situ combustion process to generate heat and carbon dioxide as a solvent. No direct injection of steam was embodied in his process.

U.S. Pat. No. 4,127,170 (Redford) relates to a viscous oil recovery method employing steam and hydrocarbons. The method is essentially continuous with injection pressures being adjusted to control production rates.

U.S. Pat. No. 4,166,503 (Hall et al.) relates to a high vertical conformance steam drive oil recovery method employing infill wells as well as injection and production wells. The method employs steam and hydrocarbons but appears primarily to address problems relating to steam channeling and overriding.

In 1985, Islip and Shuh described in U.S. Pat. No. 4,513,819 a cyclic solvent assisted steam injection process for recovery of viscous oil. On the basis of two-dimensional radial numerical simulations they propose a cyclic steam/solvent drive process between injection and producing wells. The process they represented requires a fluid communication zone located in the bottom of the formation between injection and producing wells with the latter completed near the top of the formation. The ratio of solvent to steam is set at between 2 and 10 volume percent to enhance the base cycle steam drive process. The major difference with our LASER-CSS disclosure is that we continue to operate in a cyclic steam stimulation mode using hydrocarbon additives at each CSS well, without forcing injected fluids to be transferred and driven towards adjacent wells. As described in their simulations, Islip and Shuh's process requires the presence of a bottom water zone to ensure that effective communication remains in the lower part of the formation.

Subsequently in 1987, Vogel described in U.S. Pat. No. 4,697,642 a gravity thermal miscible displacement process. In contrast to Islip and Shuh, a steam and solvent vapor mixture is injected into the top of the formation to establish a vapor zone across the top of the formation. The solvent vapors as they condense and go in solution with the viscous hydrocarbons, further reduce the viscosity of the viscous hydrocarbon, thereby enabling the native hydrocarbons to drain faster under the force of gravity into an adjacent well completed at the bottom of the reservoir. Vogel's process is essentially operated as a continuous injection process, not in a cyclic mode. A potential problem with his approach is rapid breakthrough of injected solvent vapors at adjacent producing wells as these solvent vapors traverse across the overriding steam blanket. This continuous by-passing makes it difficult to control the storage and effectiveness of hydrocarbon steam additives to contact and dissolve into a significant part of the heavy oil or bitumen residing between communicating wells.

A decade later in 1997, Richardson et al. in 1997 described in U.S. Pat. No. 5,685,371 another hydrocarbon assisted thermal recovery method. The authors point out that the action of low molecular weight additives into a reservoir undergoing steamflooding has been marginal in improving steamflood oil recovery. They suggest that this is probably due to the fact that "most of the low molecular weight additive moves quickly through the formation and is produced with the vapor phase". This bypassing of light hydrocarbons will be particularly severe in continuous steamflood operations where preferential channeling towards specific wells invariably develops inside a formation. Richardson instead proposes to use heavier hydrocarbons to counteract this by-passing, as these heavier hydrocarbons will condense more readily while in transit between wells. Therefore, he recommends using hydrocarbons having a boiling point higher than water (e.g. C7+ or selected cuts from refinery operations). With LASER-CSS our intention is to use natural condensate streams, commonly referred to as diluents, as solvent additives of choice for steam. This is because such diluent streams are already available on site in Alberta to facilitate transportation by pipeline of produced heavy oils. Accordingly, the fraction of diluent reproduced with LASER-CSS will decrease the blending requirements required on the surface to meet regulation requirements for pipeline transportation, as well as facilitate the dehydration step of produced emulsions.

Aside from all the above-related solvent addition to steam prior art inventions, in 1982 Butler described in U.S. Pat. No. 4,344,485 a method for continuously producing viscous hydrocarbons by gravity drainage while injecting heated fluids like steam. Since then the method has often been referred by those skilled in the art as Steam-Assisted-Gravity-Drainage or SAGD. However, Conventional CSS methods remain the most successful and proven for recovering viscous bitumen hydrocarbons. Batycky published an assessment of in situ oil sands recovery processes in 1997 (Journal of Canadian Petroleum Technology, Volume 36, p.15–19, October 1997 ). In a section on CSS at Cold Lake, he described how development of field steaming strategies with maximum overlap and alignment between rows of wells have been used to control the movement of fluids across the field. Proposed enhancement of CSS with LASER-CSS is intended to conform with the best CSS injection practices. Similarly, during production cycles, bottomhole rod pump operations are adjusted to maximize produced inflow volumes of mobilized reservoir fluids as the reservoir surrounding each well is blown down, while at the same time avoiding inefficient excessive venting of free steam and other vapors. Our intention is to operate the LASER-CSS process using the same bottom-hole production equipment that is used in our conventional CSS operations.

As the CSS process matures across its cycles, its efficiency also declines and only a limited fraction of bitumen is recovered. Therefore, there is a continuing need for an improved thermal process for a more effective recovery of viscous hydrocarbons from subterranean formations such as in Canadian tar sands deposits.

SUMMARY OF THE INVENTION

An improved steam stimulation recovery process referred to as Liquid Addition to Steam for Enhancing Recovery of Cyclic Steam Stimulation, or LASER-CSS is disclosed, which is based on the principle of combining solvent viscosity reduction and thermal viscosity reduction effects to enhance the effectiveness of cyclic stimulation processes. In practice, this means that at least one steam stimulation cycle is desirable, and generally several cycles will be performed to use and recover the solvent most effectively. However, instead of injecting a slug of an appropriate hydrocarbon solvent into the formation prior to the steam, LASER-CSS looks more specifically at co-injecting the solvent with the injected steam during steam injection cycles into each well. Also, the preferred type of solvent in LASER-CSS consists of on-site commercial diluent already used for transportation of thermally produced bitumen. Commercially available diluent streams have a boiling point range for the most part less than the steam injection temperature and greater than the initial reservoir temperature. We have found that in a three-dimensional CSS physical model after having conducted several conventional CSS cycles, the addition of diluent into the steam greatly improves the efficiency and productivity of subsequent LASER-CSS compared to straight CSS cycles.

The invention provides a process for recovering viscous oil from a subterranean deposit, which process comprises: (a) injecting steam into said deposit and then; (b) shutting said steam in said deposit to lower viscosity of at least a portion of said viscous oil and then; (c) recovering oil of lowered viscosity from said deposit; and (d) repeating steps (a) to (c) to form a steam chamber in said deposit and then; (e) co-injecting steam and a hydrocarbon solvent into said deposit and then; (f) shutting said steam and said hydrocarbon solvent in said deposit to lower viscosity of at least a portion of said viscous oil and then; (g) recovering oil of lowered viscosity from said deposit; and (g) repeating steps (e) to (g) as required.

In a second embodiment, the invention provides a process for recovering viscous oil from a subterranean deposit penetrated by at least two wells, which process comprises (a) injecting steam into said deposit through a first well and then; (b) shutting said steam in said deposit to lower viscosity of at least a portion of said viscous oil and then; (c) repeating steps (a) and (b) to form a steam chamber in said deposit and then; (d) recovering oil of lowered viscosity from said deposit through a second well and then; (e) co-injecting steam and a hydrocarbon solvent into said deposit through the first well and then; (f) shutting said steam and said hydrocarbon solvent in said deposit to lower viscosity of at least a portion of said viscous oil and then; (g) recovering oil of lowered viscosity from said deposit through the second well; and (h) optionally, repeating steps (e) to (g).

The invention may additionally comprise cyclically alternating between (i) injecting steam or steam and a hydrocarbon solvent into a first adjacent well while holding a second adjacent well shut and (ii) shutting said steam or steam and a hydrocarbon solvent into said first adjacent well and opening and recovering viscous oil from said second adjacent well.

The invention also may additionally comprise cyclically alternating between (i) co-injecting steam and a hydrocarbon solvent into a first adjacent well while holding a second adjacent well shut and (ii) shutting said steam or steam and a hydrocarbon solvent into said first adjacent well and opening and recovering viscous oil from said second adjacent well.

In preferred embodiments, at least one of the wells is upstanding with respect to the ground and may indeed be substantially vertical. In alternative embodiments, the well may be slanted with respect to the ground or even substantially horizontal.

In further preferred embodiments, the solvent is a hydrocarbon diluent suitable for transporting bitumen. The solvent may have an average initial boiling point close to the boiling point of pentane (36° C.) or hexane (69° C.) though the average boiling point (defined further below) may change with re-use as the mix changes (some of the solvent originating among the recovered viscous oil fractions). Preferably more than 50% by weight of the solvent has an average boiling point lower than the boiling point of decane (174° C.). It is more preferred that more than 75% by weight, more especially more than 80% by weight, and particularly more than 90% by weight of the solvent has an average boiling point between the boiling point of pentane and the boiling point of decane.

In further preferred embodiments, the solvent has an average boiling point close to the boiling point of hexane (69° C.) or heptane (98° C.), or even water (100° C.).

In additional preferred embodiments, more than 50% by weight of the solvent (more particularly more than 75% or 80% by weight and especially more than 90% by weight) has a boiling point between the boiling points of pentane and decane. In other preferred embodiments, more than 50% by weight of the solvent has a boiling point between the boiling points of hexane (69° C.) and nonane (151° C.), particularly preferably between the boiling points of heptane (98° C.) and octane (126° C.).

DETAILED DESCRIPTION OF THE INVENTION

Figure 1:
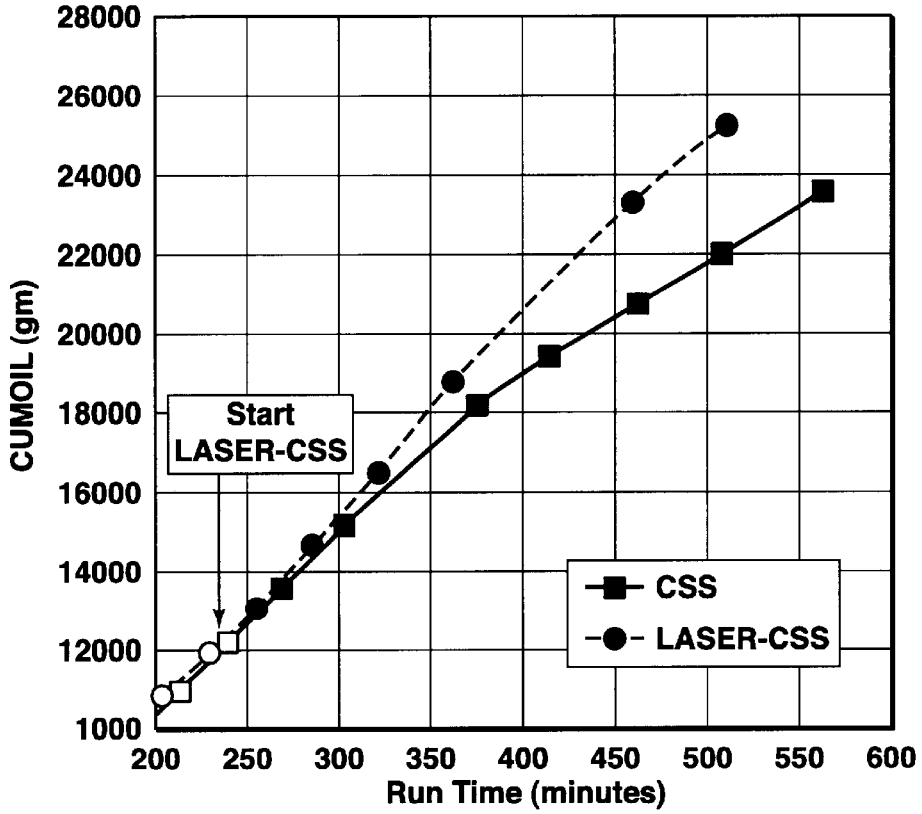
FIG. 1 is a plot illustrating the increased bitumen production using LASER-CSS when using 5% by volume (liquid equivalent basis) diluent addition into steam compared to CSS.

LASER-CSS is a method to improve steam stimulation process for recovering normally immobile viscous oil from a subterranean formation. Oil is recovered from a heavy oil formation by subjecting the formation to at least one starting cycle of steam stimulation (and preferably more than one). This is followed by injecting of a mixture of hydrocarbon solvent with steam instead of only steam into subsequent injection cycles. With LASER-CSS, solvent injection after at least one starting steam stimulation cycle (preferably more) is desirable for three basic reasons. First, in early cycles, most of the steam injected occurs at or near fracturing pressures and the distribution of solvent due to fracturing and fingering would remain uncontrolled. Second, in early CSS cycles native solution gas drive effects remain very efficient under steam stimulation alone, and oil contacted by solvent would be produced anyhow by such drive mechanisms. Third, in early cycles, thermal heat losses to adjacent formations remain very low, so that the relative benefits of non-thermal solvent addition remain relatively smaller than in later, more thermally inefficient CSS cycles. The transition from a CSS to a LASER-CSS operating mode is expected to occur when most of the solvent can be co-injected with steam at less than formation fracturing or parting pressure, when a relatively steady build-up of pressure develops throughout each injection cycle.

The hydrocarbon solvent, preferably an on site diluent or natural gas condensate stream that is commonly used for transportating heavy oils to markets, typically contains a significant amount of low molecular weight paraffinic hydrocarbons. The preferred solvent herein referred as a typical diluent has a initial boiling point close to that of pentane (36° C.) and a boiling point range for the most part less than that of decane (174° C.). Usually an average boiling point close to that of heptane (98° C.) or that of water (100° C.) is typical of the phase behavior of these diluent streams in Alberta where the world largest CSS operations are presently developed. The expression "for the most part" is used because available diluent hydrocarbon solvents may have from time to time more components which boil above the steam injection temperature, and other components which may boil above the boiling point of decane; however, a majority of the hydrocarbon components should preferably have equivalent boiling point between pentane and decane.

By average boiling point of the solvent, we mean the boiling point of the solvent remaining after half (by weight) of a starting amount of solvent has been boiled off as defined by ASTM D 2887 (1997 ) for example. The average boiling point can be determined by gas chromatographic methods or more tediously by distillation. Boiling points are defined as the boiling points at atmospheric pressure.

As an alternative to a natural gas condensate diluent, similar boiling point fractions of synthetic crude can also be utilized, especially when these crudes become more readily available.

For ease of operation of the invention, the ratio of water to solvent, preferably is high enough to prevent foaming of pumped liquids.

Proportions of solvent compared to water typically range from 99 parts water to 1 part solvent through an intermediate range of 98 parts water to 2 parts solvent, a further intermediate range of about 95 parts water to 5 parts solvent to about 90 parts water to 10 parts solvent (where both solvent and water are measured as liquid volume).

LASER-CSS enhancement method is applicable before or after substantial interwell communication has developed across the CSS maturing field. Since the diluent solvent will have typically an average boiling point similar to that of water, it is reasonably expected that the solvent will travel inside the reservoir as a vapor also to comparable distances as steam vapors. Over the last decade, high overlap steaming strategies have been applied in CSS operations to manage and minimize these interwell communication effects.

Basically, "Steam stimulation" is a method for thermally stimulating a producing well by heating the formation spacing surrounding a wellbore. This technique is often referred to as the "huff and puff" process, and has also been referred to as a "steam soak" or "push-pull" process. In general, a steam stimulation process comprises a steam injection phase, a brief shut-in period, and an oil production phase. Typical steam injection volumes increase from cycle to cycle to access bitumen further away from the wellbore. The primary objective of a steam stimulation process is to transport thermal energy into the formation and permit the rock and reservoir fluids to act as a heat exchanger. This heat then not only lowers the viscosity of the oil flowing through the heated volume but also stimulates the evolution of native gas that can provide strong additional solution gas drive mechanisms. Normally, water-oil ratios are quite high when the well is first returned to production, but the amount of water produced will suddenly decline as the oil production rate rises to a maximum before declining to a low value when the next steam injection cycle will be initiated.

Each steam injection, soak, and oil production cycle can be and is often repeated for a given well or wells. However, it has been the general experience that oil-steam ratio efficiency will decrease with successive cycles. The reasons for this are several fold; first, native solution gas is produced faster than native viscous oil leading to a relatively large decrease in solution gas drive effects from cycle to cycle; second, steam override tendency leads to a larger fraction of the heat injected to be dissipated into adjacent non-productive formations; and third, the targeted recoverable oil becomes depleted farther and farther from the well. Therefore, the process loses efficiency, oil production declines and eventually the operation becomes uneconomic, leaving still a large fraction of the original oil in place. The method of the present invention can significantly improve the amount of oil which can be ultimately recovered from the formation volume which has already been treated, contacted or otherwise affected by injected steam.

Conventional vertical or slanted thermally completed wells drilled from a common surface location will be likely used for practicing the present invention. However, the present invention is not limited to this particular well configuration and could in principle be extended to CSS with horizontal wells if these can be proven as effective as vertical wells to draw down fluids from the formation, as seems to be suggested by U.S. Pat. No. 6,158,510. After several cycles the amount of fluids withdrawn from the formation will significantly exceed that of injected fluids, and a net voidage area referred to herein as a "steam chamber", will have formed around each CSS well in the formation and will increase in size with subsequent steam stimulation cycles. The steam chamber will have a relatively low oil saturation compared to its original saturation. The creation of this depleted saturation over several CSS cycles is a key to the practice of this invention.

Then a fixed amount of liquid diluent or solvent is injected to flash and mix into the steam distribution lines during the next steam stimulation cycle. The diluent having the characteristics previously described will vaporize into the steam during injection and condense more or less at the periphery of the previously steam stimulated formation but will not vaporize in significant amounts during subsequent production. As mentioned, the typical diluent solvent consists of a hydrocarbon mixture wherein the hydrocarbons contain mostly five to ten atoms of carbon; i.e., pentane, hexane, heptane, octane, nonane or decane and isomers thereof.

The quantity of the diluent injected into the steam can in principle be as low as desired but should be preferably chosen as large as possible to maximize its effect. However, the quantity should be chosen to remain well within the maximum solubility of diluent expected at typical bottom hole thermodynamic conditions experienced during CSS production cycles. Otherwise, foaming of inflowing fluids from the reservoir into the wellbore will occur; which could significantly impair the smoothness of downhole pumping operations. After most of the water condensate is produced at the front end of a CSS cycle, most of the stimulated oil is produced at bottomhole temperatures that typically decline from 200 to 150° C. with the bottomhole pressure maintained as low as possible while still preventing flashing of steam. It is important to maximize drawdown of mobilized reservoir fluids to operate cyclic recovery processes at their fullest potential through each cycle. The same operating practices are envisioned with LASER-CSS technology and accordingly the maximum practical quantity of diluent addition to steam will have to be determined based on actual field operating experience. The basic guideline criterion is that the solvent or diluent that is recovered remains for the most part soluble in the produced heavy oil or bitumen at the bottomhole conditions typical of base CSS operations.

In general, the mechanics of performing the individual steps of this invention will be well known to those skilled in the art although the combination has not heretofore been recognized. Further, it should be recognized that each reservoir will be unique. The number of CSS stimulation cycles before solvent or diluent addition to steam will depend upon a number of factors, including the quality of the reservoir, the volume of steam injected, the injection rate and the temperature and quality of the steam. The number of subsequent CSS stimulation cycles with diluent addition to steam as in LASER-CSS will also depend on the above as well as the quantity of diluent added to steam in each of these later cycles. Ultimately, as per conventional CSS, an economic limit will be reached after recovering a significant amount of oil in place beyond that the ultimate recovery that would have been reached by ongoing conventional CSS operations.

Experimental Results

Laboratory results confirm that significant improvement in bitumen recovery performance with CSS is obtained through the practice of this invention. The experimental apparatus consisted of a large 100×60×35 cm three-dimensional physical model with a single CSS well located in the center of the reservoir model. The model is placed inside a high pressure cylindrical vessel that is set to operate at a fixed confining pressure of 7 MPa during experiments. The prototype reservoir model is designed to scale field gravity drainage forces occurring in the field and is packed with a coarser sand according to basic scaling criteria. In mature CSS operations, gravity becomes increasingly the dominant production driving force. At the start of a typical CSS experiment, the reservoir model consists of approximately a 14 weight % dewatered Cold Lake bitumen, 84 weight % quartz sand and 2 weight % water. The entire model was insulated so that it could be operated consistently with minimum heat losses between experiments. The initial temperature of the model was 21° C. Concentric tubing to represent an injection/production well was installed at the centre of the model and completed over a 5 cm interval in the bottom third of the model. The well is much larger in scale than in the field to ensure unconstrained inflow of mobilized reservoir fluids during production cycles. During injection 100% quality steam is introduced at a constant rate until the maximum pressure inside the model reaches the above-mentioned constraining vessel pressure. Thereafter, the model is depressurized by expanding the mobilized reservoir fluids at a constant volumetric withdrawal rate into a series of piston accumulators. Each CSS production cycle is ended when the mass flowrate of produced fluids drops to about 25% of its maximum peak values at the beginning of production. The CSS cycles are repeated until about 1 Pore Volume of steam has been injected in the model over the duration of an experiment.

Comparisons of the relative performances of one base CSS experiment with one LASER-CSS experiment using 5% volume addition of diluent into the injected steam are provided in the two attached figures to illustrate the benefits of our invention.

The diluent used was developed in house, had an average boiling point of 126° C., and comprised 25%≦C5, 3% C6(28%≦C6), 37% C7 (65%≦C7), 9% C8 (74%≦C8), 9% C9 (83%≦C9), 9% C10 (92%≦C10), the rest (8%) comprising C11 and C12. It was intended to be representative of diluents in general.

FIG. 1 illustrates the enhanced productivity obtained with LASER-CSS compared with CSS. In both experiments until about 240 minutes of similar CSS operations, a similar amount of about 12,000 gms of bitumen had been produced from our physical model. In each of the subsequent cycles 5% diluent addition was added into the injected steam in the LASER-CSS test only and operations were otherwise continued in a similar fashion. Each symbol on the graph corresponds to a cycle of operation in the two experiments. The open circles and squares are pre LASER-CSS and pre-CSS prior to starting LASER-CSS and the solid circles and squares compare LASER-CSS (solid circles) with CSS (solid squares). As may be seen from FIG. 1, by comparing the cumulative production profiles, oil productivity was significantly improved and sustained over the remaining cycles of operation leading to about 30% production enhancement across the LASER-CSS cycles.

Figure 2:
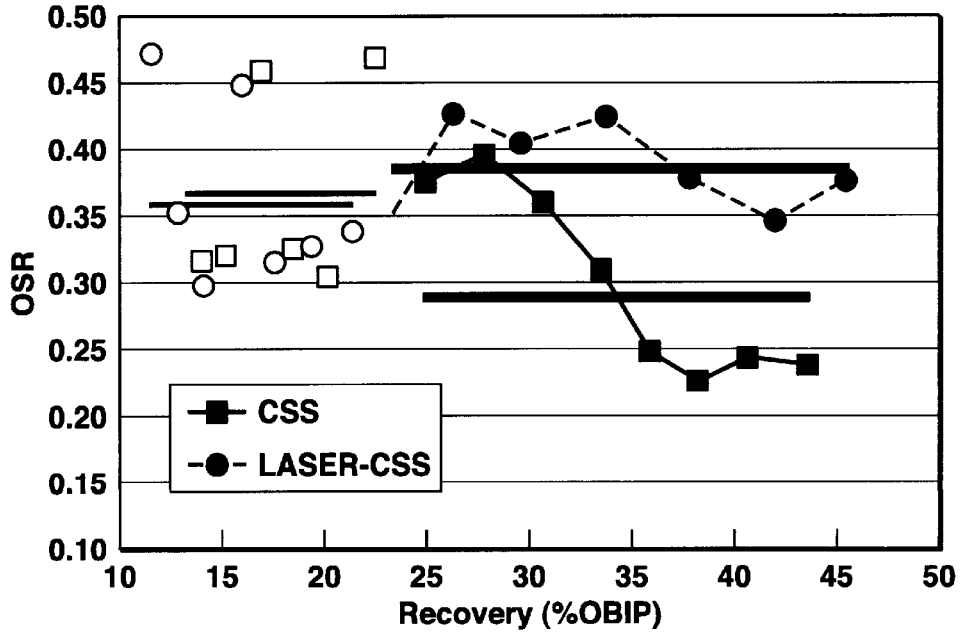
FIG. 2 is a plot illustrating the improved thermal recovery efficiency with LASER-CSS when using 5% by volume (liquid equivalent basis) diluent addition into steam compared to CSS.

FIG. 2 complements FIG. 1 by showing the enhancement in thermal efficiency witnessed across the LASER cycles. It plots Oil-Steam-Ratio (OSR) performance of each individual cycle for the same two experiments as a function of percent original bitumen in place or (OBIP) recovery for the above experiments. The open symbols show the seven cycles of operation preceding initiation of LASER-CSS for the last 7 cycles, with pre-LASER CSS shown as open circles and pre-CSS shown as open squares. The thermal recovery performance of the two tests was very similar with an average OSR of about 0.35 in the early CSS tests. After introduction of diluent with steam in the LASER-CSS test, the thermal efficiency was sustained until the test was ended after recovering over 45% OBIP. By contrast, the performance of the CSS test declined steadily while reaching a similar recovery level. This means that the consumption of steam to recover the same amount of bitumen in later cycles was significantly higher in CSS than with LASER-CSS. The solid symbols show that in average for the last 7 cycles LASER-CSS solid circles was about 30% more thermally efficient than CSS (solid squares) by itself.

Various modifications of this invention will be apparent to those skilled in the art without departing from the spirit of the invention. Further, it should be understood that this invention should not be limited to the specific experiments set forth herein.

What is claimed is:

1. A process for recovering viscous oil from a subterranean deposit penetrated by at least one well, which process comprises:

(a) injecting steam into said deposit and then;

(b) shutting said steam in said deposit to lower viscosity of at least a portion of said viscous oil and then;

(c) recovering oil of lowered viscosity from said deposit; and (d) repeating steps (a) to (c) to form a steam chamber in said deposit and then;

(e) co-injecting steam and a hydrocarbon solvent into said deposit and then;

(f) shutting said steam and said hydrocarbon solvent in said deposit to lower viscosity of at least a portion of said viscous oil and then;

(g) recovering oil of lowered viscosity from said deposit; and (h) optionally, repeating steps (e) to (g).

2. The process of claim 1 further comprising at least a first adjacent well and a second adjacent well and cyclically alternating between step by co-injecting steam and a hydrocarbon solvent into a first adjacent well while holding a second adjacent well shut and step by shutting said steam and hydrocarbon solvent into said first adjacent well and opening and recovering viscous oil from said second adjacent well.

3. The process of claim 1 further comprising at least a first adjacent well and a second adjacent well and cyclically alternating between step by co-injecting steam or steam and a hydrocarbon solvent into a first adjacent well while holding a second adjacent well shut and step by shutting said steam or steam and a hydrocarbon solvent into said first adjacent well and opening and recovering viscous oil from said second adjacent well.

4. A process according to claim 2, wherein at least one of said wells is upstanding with respect to the ground or is substantially vertical with respect to the ground.

5. A process according to claim 2, wherein at least one of said wells is slanted with respect to the ground or is substantially horizontal with respect to the ground.

6. A process according to claim 2, wherein said solvent is a natural or synthetic diluent suitable for transporting bitumen.

7. A process according to claim 6, wherein more than 50% by weight of said solvent has an average boiling point between the boiling point of pentane and the boiling point of decane.

8. A process according to claim 6, wherein more than 75% by weight of said solvent has an average boiling point between the boiling point of pentane and the boiling point of decane.

9. A process according to claim 6, wherein more than 80% by weight of said solvent has an average boiling point between the boiling point of pentane and the boiling point of decane.

10. A process according to claim 6, wherein more than 90% by weight of said solvent has an average boiling point between the boiling point of pentane and the boiling point of decane.

11. A process according to claim 6, wherein said solvent has an average boiling point between the boiling points of pentane and decane.

12. A process according to claim 6, wherein said solvent has an average boiling point between the boiling points of hexane and nonane.

13. A process according to claim 6, wherein said solvent has an average boiling point between the boiling points of heptane and octane.

14. A process according to claim 6, wherein said solvent has an average boiling point between the boiling points of heptane and water.

15. A process according to claim 6, wherein said solvent comprises hexane.

16. A process for recovering viscous oil from a subterranean deposit penetrated by at least two wells, which process comprises:

(a) injecting steam into said deposit through a first well and then;

(b) shutting said steam in said deposit to lower viscosity of at least a portion of said viscous oil and then;

(c) repeating steps (a) and (b) to form a steam chamber in said deposit and then;

(d) recovering oil of lowered viscosity from said deposit through a second well and then;

(e) co-injecting steam and a hydrocarbon solvent into said deposit through the first well and then;

(f) shutting said steam and said hydrocarbon solvent in said deposit to lower viscosity of at least a portion of said viscous oil and then;

(g) recovering oil of lowered viscosity from said deposit through the second well; and (h) optionally, repeating steps (e) to (g).

17. A process according to claim 16, wherein said solvent has an average boiling point between the boiling points of pentane and decane.

18. A process according to claim 16, wherein said solvent has an average boiling point between the boiling points of hexane and nonane.

19. A process according to claim 16, wherein said solvent has an average boiling point between the boiling points of heptane and octane.

20. A process according to claim 16, wherein said solvent has an average boiling point between the boiling points of heptane and water.

* * * * *